US010758943B1

(12) United States Patent
Carpenter

(10) Patent No.: US 10,758,943 B1
(45) Date of Patent: Sep. 1, 2020

(54) CONTAINER-BASED MATERIAL HANDLING FOR AUTOMATIC PARCEL SACKING SYSTEM

(71) Applicant: Siemens Postal, Parcel & Airport Logistics LLC, DFW Airport, TX (US)

(72) Inventor: Michael D. Carpenter, Arlington, TX (US)

(73) Assignee: SIEMENS LOGISTICS LLC, DFW Airport, TX (US)

( * ) Notice: Subject to any disclaimer, the term of this patent is extended or adjusted under 35 U.S.C. 154(b) by 0 days.

(21) Appl. No.: 16/393,991

(22) Filed: Apr. 25, 2019

(51) Int. Cl.

| | |
|---|---|
| ***B07C 3/00*** | (2006.01) |
| ***B07C 5/16*** | (2006.01) |
| ***B07C 5/34*** | (2006.01) |
| ***B07C 3/18*** | (2006.01) |
| ***B07C 3/12*** | (2006.01) |
| ***B07C 3/08*** | (2006.01) |

(52) U.S. Cl.
CPC ..... *B07C 3/003* (2013.01); *B07C 3/08* (2013.01); *B07C 3/12* (2013.01); *B07C 3/18* (2013.01); *B07C 5/16* (2013.01); *B07C 5/34* (2013.01); *B07C 2301/0016* (2013.01)

(58) Field of Classification Search
None
See application file for complete search history.

(56) References Cited

U.S. PATENT DOCUMENTS

| | | | | |
|---|---|---|---|---|
| 6,126,017 | A * | 10/2000 | Hours | B07C 3/008 198/370.03 |
| 6,276,509 | B1 * | 8/2001 | Schuster | B07C 3/008 198/370.02 |
| 6,561,339 | B1 | 5/2003 | Olson et al. | |
| 7,304,260 | B2 * | 12/2007 | Boller | B07C 3/008 198/370.02 |
| 8,080,758 | B2 * | 12/2011 | Rosenbaum | B07C 3/008 209/584 |
| 10,322,438 | B2 * | 6/2019 | Engel | B07C 1/025 |
| 2018/0085788 | A1 * | 3/2018 | Engel | B07C 3/008 |

FOREIGN PATENT DOCUMENTS

WO WO2017151897 A1 9/2017

* cited by examiner

*Primary Examiner* — William R Harp

(57) ABSTRACT

A parcel sorting system and related process. The parcel sorting system includes a parcel sorter, a plurality of shuttles, and a control system. The control system is configured to control the parcel sorting system to assign a first sorting destination to a first output of a plurality of outputs. A first container is positioned to receive parcels sorted to the first output. The control system is configured to control the parcel sorting system to sort parcels corresponding to the first sorting destination to the first output and deposit the parcels into the first container; when the first container has reached a target capacity, remove the full first container using a first shuttle; and position a third container to receive parcels sorted to the first output using a second shuttle.

17 Claims, 7 Drawing Sheets

CONTAINER-BASED MATERIAL HANDLING FOR AUTOMATIC PARCEL SACKING SYSTEM

TECHNICAL FIELD

Aspects of the present invention generally relate to a parcel management and transportation system and a method.

BACKGROUND OF THE DISCLOSURE

Parcel sack management entails sweeping, tracking, sack filling, identification of the sack and/or contents, closing of the sacks and takeaway of the filled sacks. Currently parcel sack management is done manually by several people at each step of the process, and then the parcel sacks are also manually handled.

SUMMARY OF THE DISCLOSURE

Various disclosed embodiments include a parcel sorting system. The parcel sorting system includes a parcel sorter having a plurality of outputs and a plurality of shuttles. The shuttles are configured to travel on shuttle tracks to positions proximate to each of the outputs. The parcel sorting system includes a control system, configured to control the parcel sorting system to perform certain operations. The parcel sorting system is controlled to assign a first sorting destination to a first output of the plurality of outputs, wherein a first container is positioned to receive parcels sorted to the first output. The parcel sorting system is controlled to sort parcels corresponding to the first sorting destination to the first output and deposit the parcels into the first container. The parcel sorting system is controlled to, when the first container has reached a target capacity, remove the full first container using a first shuttle. The parcel sorting system is controlled to position a third container to receive parcels sorted to the first output using a second shuttle.

Other embodiments include parcel management and sorting processes and computer-readable mediums. In various embodiments, the control system is further configured to control the parcel sorting system to, when the first container has reached the target capacity, assign the first sorting destination to a second output of the plurality of outputs, wherein a second container is positioned to receive parcels sorted to the second output. In various embodiments, the control system is further configured to control the parcel sorting system to, after the third container is positioned to receive parcels sorted to the first output, assign a second sorting destination to the first output. In various embodiments, the target capacity is one of a capacity of a parcel sack, a capacity of the first container, or a target weight capacity. Various embodiments also include a transfer mechanism configured to move the first container onto the first shuttle from being positioned to receive parcels sorted to the first output. In various embodiments, the shuttle tracks comprise a rail system along which the plurality of shuttles travel. In various embodiments, the control system is further configured to control the parcel sorting system to, after the third container is positioned to receive parcels sorted to the first output, change a status of the first output to indicate that the first output is available for assignment. In various embodiments, the first shuttle is the second shuttle and is configured to transport two containers at the same time.

The foregoing has outlined rather broadly the features and technical advantages of the present disclosure so that those skilled in the art may better understand the detailed description that follows. Additional features and advantages of the disclosure will be described hereinafter that form the subject of the claims. Those skilled in the art will appreciate that they may readily use the conception and the specific embodiment disclosed as a basis for modifying or designing other structures for carrying out the same purposes of the present disclosure. Those skilled in the art will also realize that such equivalent constructions do not depart from the spirit and scope of the disclosure in its broadest form.

Before undertaking the DETAILED DESCRIPTION below, it may be advantageous to set forth definitions of certain words or phrases used throughout this patent document: the terms "include" and "comprise," as well as derivatives thereof, mean inclusion without limitation; the term "or" is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, whether such a device is implemented in hardware, firmware, software or some combination of at least two of the same. It should be noted that the functionality associated with any particular controller may be centralized or distributed, whether locally or remotely. Definitions for certain words and phrases are provided throughout this patent document, and those of ordinary skill in the art will understand that such definitions apply in many, if not most, instances to prior as well as future uses of such defined words and phrases. While some terms may include a wide variety of embodiments, the appended claims may expressly limit these terms to specific embodiments.

BRIEF DESCRIPTION OF THE DRAWINGS

For a more complete understanding of the present disclosure, and the advantages thereof, reference is now made to the following descriptions taken in conjunction with the accompanying drawings, wherein like numbers designate like objects, and in which.

DETAILED DESCRIPTION

Figure 1:
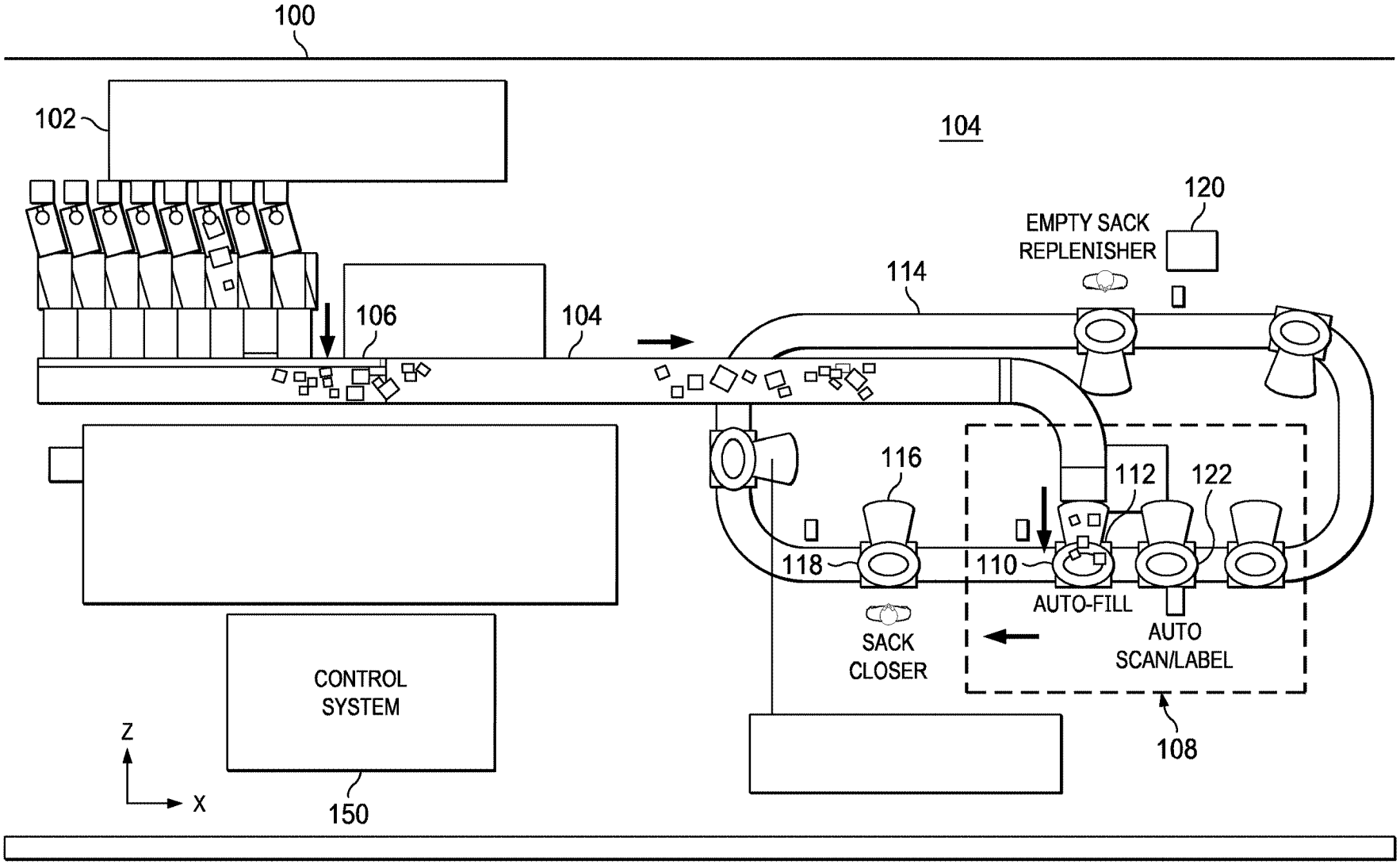
FIG. 1 illustrates an embodiment of a parcel sack management system.

The figures discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device. The numerous innovative teachings of the present application will be described with reference to exemplary non-limiting embodiments.

Current processes for transporting parcels include manual, personnel-intensive processes for placing parcels in sacks and tracking sacks and/or the individual parcels. Such processes are labor intensive and can be prone to error. Disclosed embodiments provide technical solutions for eliminating these issues.

Parcel delivery services, such as the United Parcel Service, deal with everything that occurs for every item that they deliver between the origination and the destination across the delivery logistic. During the delivery process, there are typically multiple instances in which sorting occurs at intervals amid transportation steps. In these incremental, repetitive sorting processes, items are grouped according to geographic areas that are progressively smaller, such that in multiple steps, an individual item finds itself comingled with items that share a subsequent transportation step. Ultimately, this process finds its conclusion in a delivery vehicle loaded with items that share a delivery route.

Within this process, delivery services handle parcels differently depending on their physical characteristics, including size and weight. Parcels may then be broken into multiple classes, including "Smalls" (items that are smaller than usual), "Bigs" (normal-sized items, whose weight does not exceed what can be commonly handled), and "Irregulars," or "Irregs," which constitute anything too ungainly to be processed and transported conventionally, as either a "small" or a "big."

Smalls are processed separately from Bigs, using equipment optimized for the reduced size of the parcels. The practice has been to sort smalls to a smaller geographic area than is necessary for the subsequent transportation, enclose multiple smalls of a common geographic area in a bag that is within the physical characteristics of a big, and allow the bag of multiple smalls to be processed across multiple sorting operations as a single item according to the shared geographic destination of the multiple items enclosed.

Common practice has been to manually manage and handle smalls and the bags of smalls.

International patent application publication WO2017/151897 is hereby incorporated by reference. That application describes a mechanism for automatic high speed sweeping, tracking, sack filling, identification of the sack and/or contents, closing of the sacks, and takeaway of the filled sacks. Systems and methods disclosed in that application automate sack filling with existing sacks taking flow from existing sorters by using a transportable fill chute reservoir to handle sack filling exceptions.

FIG. 1 illustrates an embodiment of a parcel sack management system 100 in accordance with international patent application publication WO2017/151897, that can be used in conjunction with a system as disclosed herein.

Parcels are received at an intake 102, which can be, for example, a buffer configured to collect parcels from a sorter, the buffer having a plurality of buffer discharges. In this example, intake 102 includes a plurality of individually controlled buffers each with each buffer fitted with a synchronously reciprocating door, belt and paddle belt configuration to provide a controlled output.

The intake 102 transfers a plurality of parcels onto a gathering conveyor 104. When discharged from intake 102, the parcels are typically together in a parcel group 106, such as a group of parcels sorted to a common destination. The sorter can be, for example, a parcel sorter such as a tilt tray sort sorter with a plurality of reciprocating paddle belt outputs.

The parcel group 106 is transported by the gathering conveyor 104 to a sacking area 108 (sack filling station 108). At sacking area 108, the parcels in parcel group 106 are transferred (e.g., dumped) into a transportable fill chute 110 that carries a parcel sack 112 so that they automatically fill parcel sack 112. As described below, the parcel sack 112 is preferably already scanned or labeled to indicate the destination of or other information relating to parcel group 106. The "sack" refers to any sack, tote, or similar container for transporting the parcels.

In some embodiments, the gathering conveyor 104 has a parcel group tracking capability which can sense and report whether parcels remain within the computer-controlled space allocation on the gathering conveyor and, if not, the control system can determine that there is an error with the respective chute or sack, and cause the chute collecting that parcel group to be routed to the intervention station 116 described below.

A plurality of fill chutes 110 are transported along a circulating track 114. Circulating track 114 includes several stations for processing the chutes and parcel sacks. The filled parcel sack 112 is transported by the fill chute 110 to an intervention station 116.

At an optional intervention station 116, any parcels that did not fully enter the sack can be manually placed into the sack, and any other manual operations can be performed by a human operator. For example, contents in the chute that did not fully enter the sack may require manipulation to transfer into the sack before the sack is closed.

The filled parcel sack 112 is transported by the fill chute 110 to a sack closing station 118. In this example, sack closing station 118 is combined with intervention station 116, so no immediate transport is necessary. At sack closing station 118, the filled parcel sack 112 is closed either automatically or manually.

The filled and closed parcel sack 112 can be removed from the fill chute 110 for further processing at sack closing station 118 or at another point along circulating track 114.

The fill chute 110 continues along the circulating track to an empty stack replenisher 120, where an empty sack 112 is mounted on fill chute 110.

The fill chute 110, with empty sack 112, continues along circulating track to scanning-labeling station 122. Scanning-labeling station 122, in some embodiments, places a label on the empty sack 112 that includes a sack identifier associated with the parcel group 106 that will be loaded in that sack at sacking area 108. In other embodiments, scanning-labeling station 112 scans a label already on empty sack 112 to read a sack identifier associated with the parcel group 106 that will be loaded in that sack at sacking area 108.

The fill chutes 110 continue to circulate, filling empty sacks with parcel groups, closing the sacks, having the filled sacks removed, and being replenished with empty sacks.

Control system 150 controls the operation of parcel sack management system 100.

Control system 150 maintains the association between the sack identifiers and the respective parcel groups 106 that fill each sack.

Note that various "stations" and areas can be combined or separated in different embodiments. For example, the sacking area can also be the same physical area as the sack closing station, in some embodiments.

Figure 2:
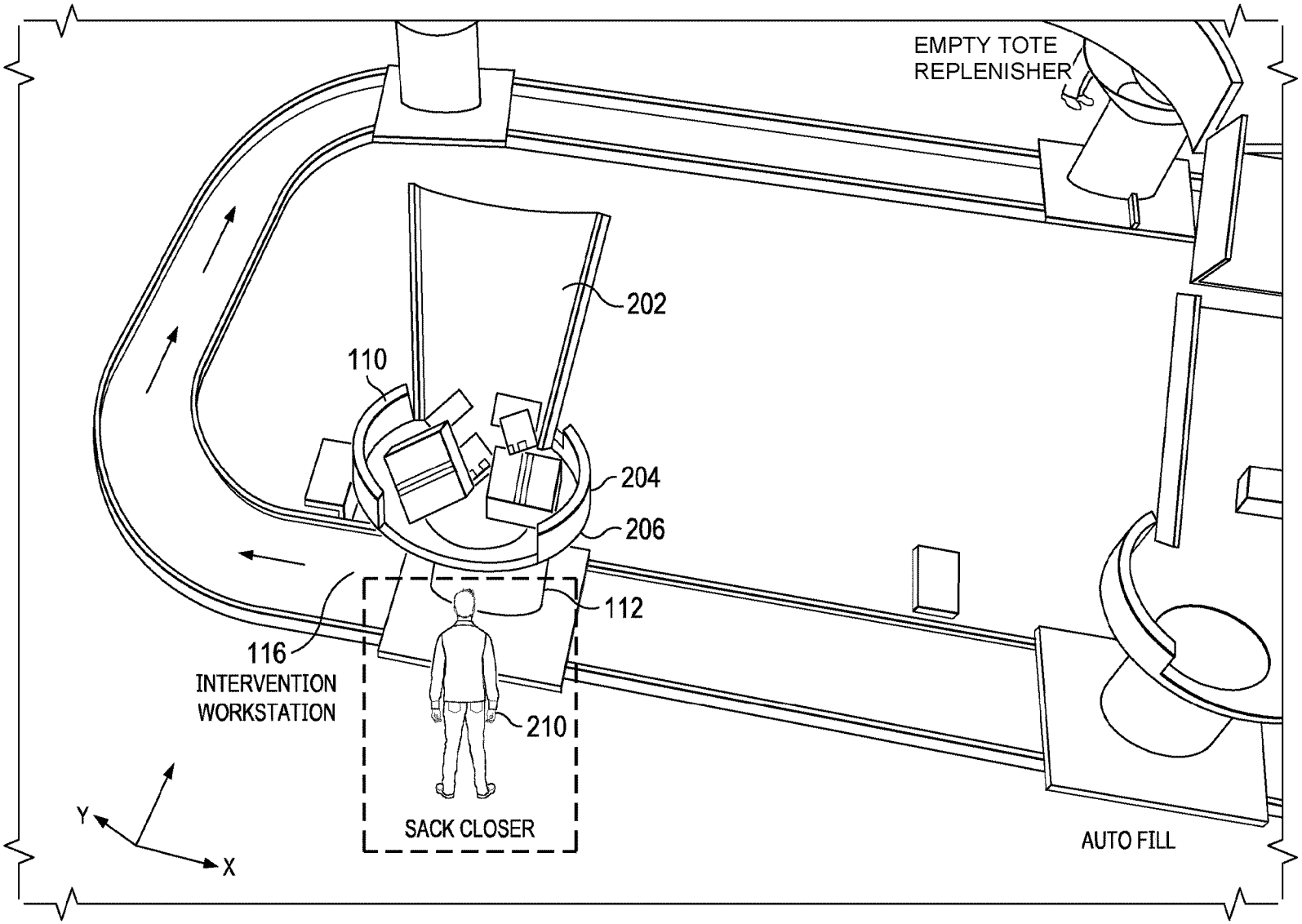
FIG. 2 illustrates a more detailed view of an embodiment of a transportable fill chute at an intervention station.

FIG. 2 illustrates a more detailed view of a transportable fill chute 110 at an intervention station 116 as described in international patent application publication WO2017/151897.

Fill chute 110 includes a chute structure 202 that is configured to receive the parcels from the gathering conveyor 104. Fill chute 110 includes a containment rim 204 that retains any packages that did not completely pass down chute structure 202 into sack 112 that is mounted on and beneath fill chute 110 on a sack holder 206. At intervention station 116, an operator 210 can manually clear any jams and ensure that all parcels are properly placed into sack 112.

Figure 3:
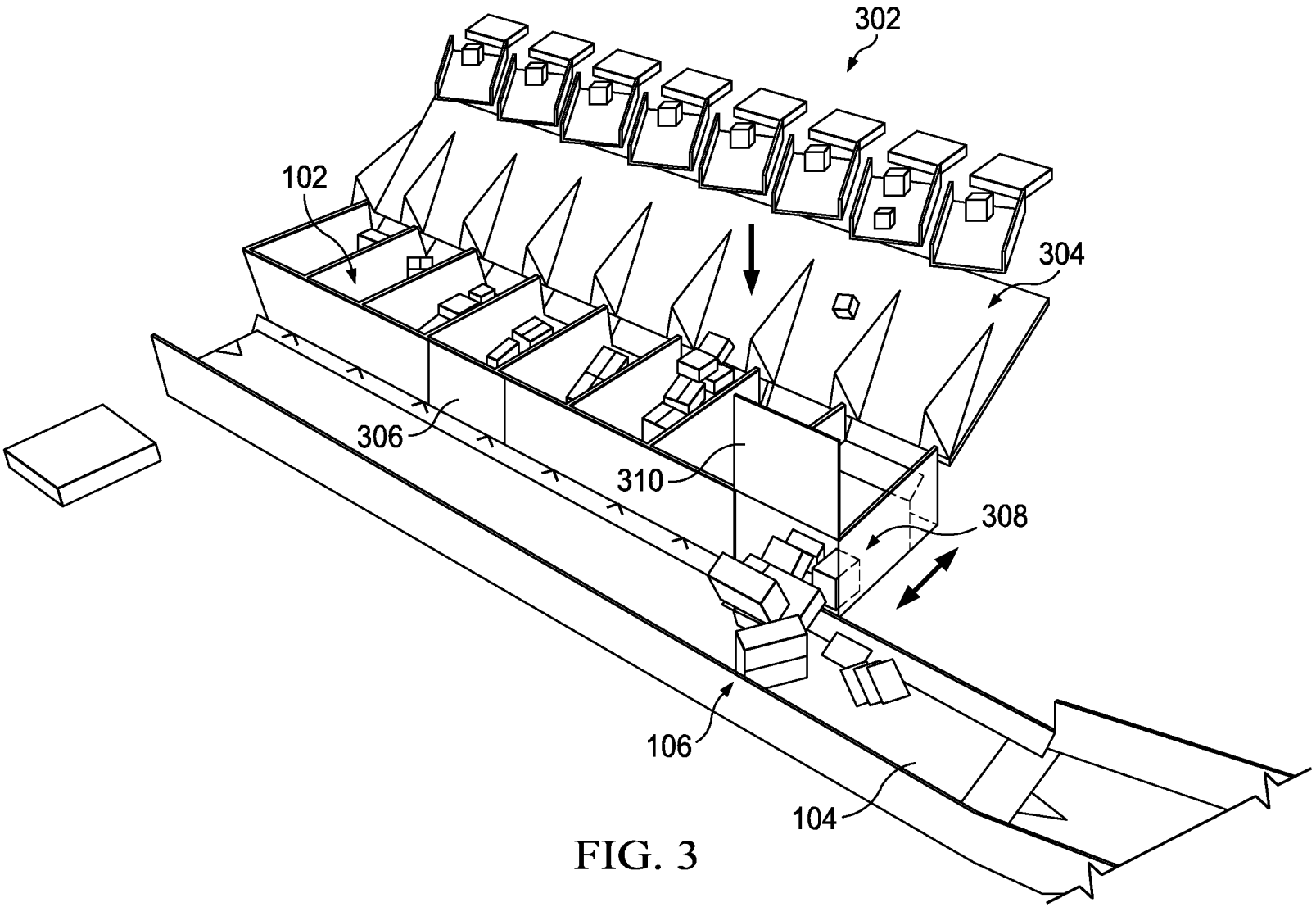
FIG. 3 illustrates an embodiment of an intake.

FIG. 3 illustrates an embodiment of an intake 102 as described in international patent application publication WO2017/151897. In this example, intake 102 is a sorter 302 with a tilt tray 304 at each output, controlled buffers 306 at each output, and a reciprocating paddle belt 308 at each output. Closable doors 310 at each output control when each parcel group 106, at each output, are released onto gathering conveyor 104. As each door 310 is opened to output a parcel group, the paddle belt 308 pushes the parcels onto the gathering conveyor 104.

A buffering system for "smalls" as illustrated in FIG. 3 can be used as part of a system as disclosed herein. In that buffering system, each chute, marking a sorting bin, has an accumulating controlled buffer 306 beneath it. Controlled buffer 306 is controlled to eject its contents (308) when the control system determines that sufficient volume has accumulated to fill a bag. The contents spill onto gathering conveyor 104 in a pile as parcel group 106, which is transported and tracked to the filling station (108 in FIG. 1).

As described in international patent application publication WO2017/151897, the parcels are sacked, sometimes with user intervention at intervention station 116, then the parcel sacks must be manually managed.

U.S. Pat. No. 6,561,339, hereby incorporated by reference, describes an alternate means of buffering and transportation. The system described in that patent used containers to accumulate items that have been sorted to bins. The containers are automatically manipulated by adjacent roller conveyors. That system described an automatic tray handling system adapted for use with a flats mail sorter that included "tray filling devices" that filled trays with sorted "flat" articles received from a mail sorter. A conveying surface conveyed empty or partially-filled trays to "tray filling areas," where tray moving devices moved empty trays from the conveying surface to the tray filling areas and then removed partially or completely filled trays back to the conveying surface. The conveying surface was arranged as a closed path to recycle trays around the closed path as they were filled and emptied. That patent was directed to "flats," which describes a certain class of postal items, typically something the size of a magazine. The UPS application of sorting "Smalls" also includes what would be called flats.

Both of the systems described above have the disadvantage of relatively complex and expensive mechanisms and equipment for each bin. Disclosed embodiments reduce complexity in moving the Smalls, thereby increasing reliability and efficiency and reducing cost.

Disclosed embodiments include a mechanism for automatic high-speed sweeping, tracking, and transport of Smalls that uses container shuttle in place of sacks for improved efficiency with less manual intervention.

Figure 4:
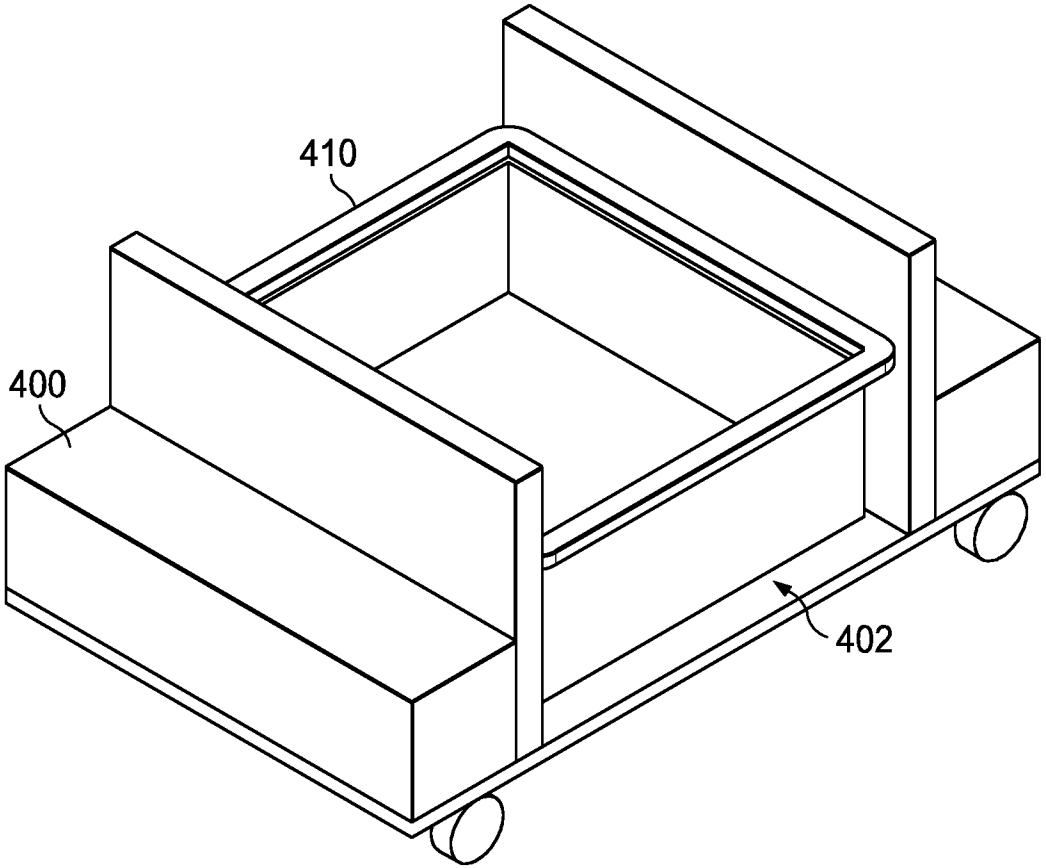
FIG. 4 illustrates a simplified example of a container shuttle 400 in accordance with disclosed embodiments.

An Automatic Storage Retrieval System (ASRS) can use high-speed, self-contained container shuttles. FIG. 4 illustrates a simplified example of a container shuttle 400 in accordance with disclosed embodiments. In this example, container shuttle 400 has a cargo area 402 configured to carry a container 410. In other embodiments, the cargo area 402 of container shuttle 400 is configured to carry more than one container 410; this is particularly advantageous if a single shuttle is used to both remove a filled container and replace it with an empty container, as described in more detail below.

Shuttle 400 is self-contained and has no wiring to connect it to controls or power during operation. Shuttle 400 can include features such as a control system, a wireless interface, a power source such as a battery, and a motor for propelling the container under the control of the control system. Shuttle 400 can include one or more sensors, such as optical sensors to detect its location and proximity to other elements of a system as disclosed herein and sensors such as weight sensors to determine the weight of the container it is transporting. Shuttle 400 is configured to run on a rail system or can be self-guided using its sensors, is relatively fast, can target positions along those rails, and can either onload or offload a "tote," similar container, or similarly sized item. Shuttle 400 can be implemented as a robotic shuttle, either independently operable by its own control system or responsive to wireless control from an overall control system. Each container 410 can be marked with an appropriate machine and/or human-readable identifier to track a container 410 and its contents aeras they are processed. Such indicia can include one or more of identifying numbers, letters, barcodes, RFID tags, or other identifiers.

Disclosed embodiments use a shuttle 400 as part of a smalls sorting system. Instead of using a complex sacking system, totes such as container 410 are placed at each bin to accumulate the equivalent volume of a sack. Shuttles such as shuttle 400 replace filled containers 410 with empty containers. A system such as that disclosed herein solves the buffering and conveying functions at much lower complexity and cost than approaches such as those described above.

For example, in the context of the example of FIG. 3, instead of an intake 102 at the tilt tray 304, the output of the sort 302 or the tilt tray 304 can be a container 410, so that the Smalls are sorted directly into containers 410. The gathering conveyor 104 and the sacking system to which it delivers parcels is no longer required, and instead the sorted Smalls are delivered directly to the containers 410, which are replaced as they are filled. The volume capacity of a container 410 can be approximately the same as a sack described above or can be of greater or lesser capacity.

Figure 5:
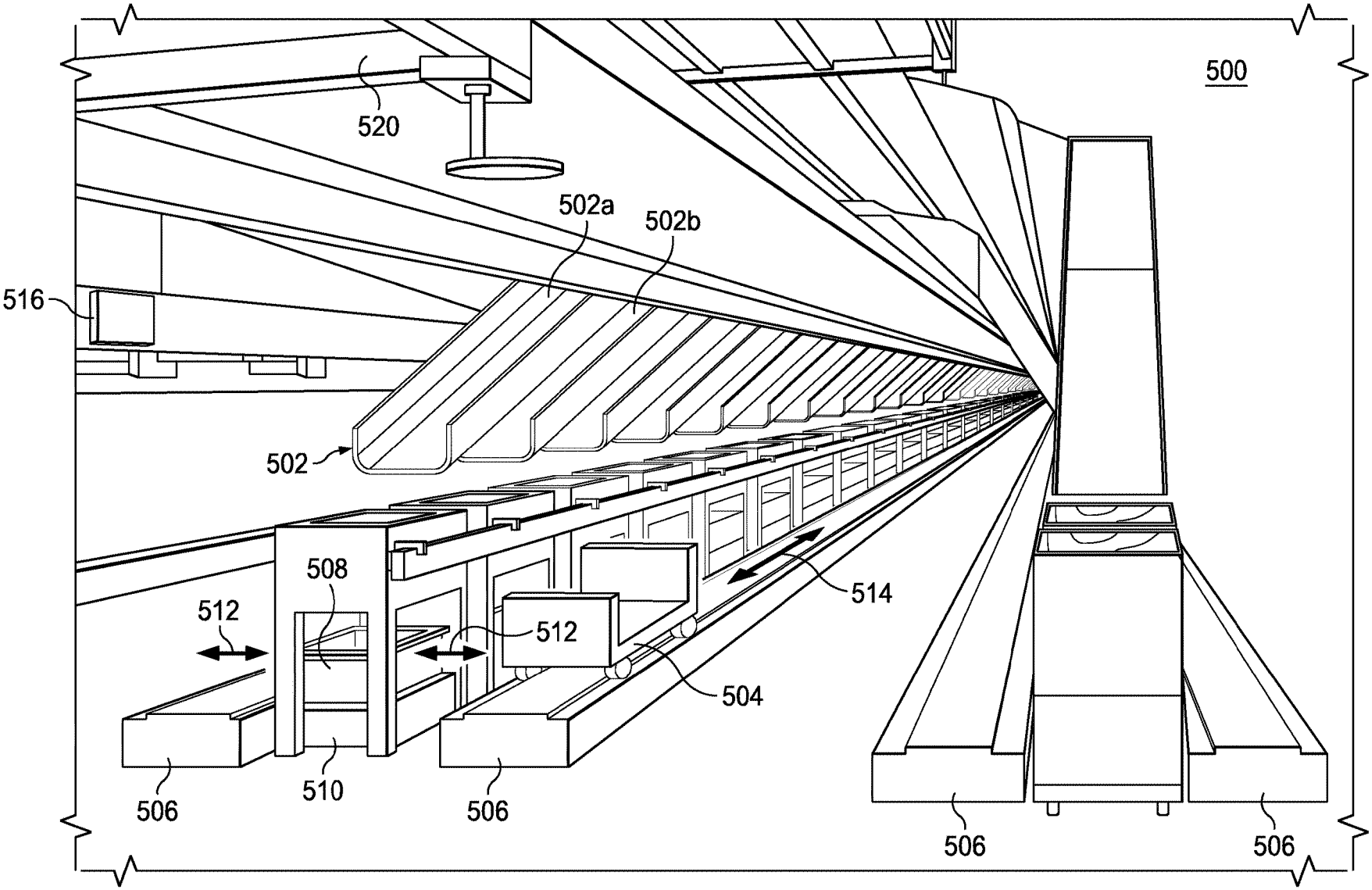
FIG. 5 illustrates an example of a sorter system in accordance with disclosed embodiments.

FIG. 5 illustrates an example of a sorter system 500 in accordance with disclosed embodiments. The sorting operations are not shown in detail here and can conform to known systems for sorting Smalls and other parcels. The sorting system controls sorter 520 sorts the Smalls or other parcels to outputs 502 (including, for example output 502*a* and output 502*b*) under the control of control system 516.

At output 502, the parcels are delivered to containers 508 positioned at each output 502. In this example, each container 508 is located under the output chute at each output 502.

Shuttles 504 transport containers 508 along shuttle tracks 506 as indicated by arrows 514. Shuttle tracks 506 can be implemented, for example, as a rail system. In other embodiments, shuttle tracks 506 can be defined in the sorter control system or the shuttle control system as travel paths with no need for a physical rail system. Shuttle tracks 508 can be designated, for example, by painted lines, of one or more colors, that can be followed by each shuttle 504. The shuttle tracks or other elements of the sorters can also have location indicia readable by sensors on each shuttle 504 to determine or confirm the shuttle's location at any time.

In various embodiments a system, the sorter system 500 actively replaces a full containers 508 with empty containers 508, so that the sorter system 500 can resume sorting to the corresponding output 502 as soon as possible.

In various embodiments, the sorter system 500 includes a transfer mechanism 510 configured to transfer a container 508 from a shuttle 504 to a position proximate to an output 502 (and vice versa) as indicated by arrow 512, so that an empty container 508 can be placed at output 502, filled, then removed back to a shuttle 504 when filled. The transfer mechanism 510 can be implemented using controllable means such as conveyors, rollers, slides, arms, or other mechanical apparatuses configured to transfer containers between shuttles and the output locations.

In other cases, the shuttle track 506 can continue beneath or proximate to output 502 so that the container 508 can be filled from output 502 while it is still carried by shuttle 504. When container 504 is filled (wholly or partially), shuttle 504 can transfer that container 508 away for another shuttle 504 to take its place carrying an empty container 508.

In various embodiments, there may be a shuttle track 506 only on one side of a set or series of outputs, and that shuttle track is used for transporting both filled and empty containers 508. In other embodiments, there may be a shuttle track 506 on each side of a set or series of outputs, so that the shuttle track on one side is designated for shuttles 504 delivering empty containers 508, while the shuttle track on the other side is designated for shuttle 504 removing filled containers 508. Alternatively, shuttle tracks on each side may be employed to increase the handling rate of the overall system.

Sorting system 500 can dynamically assign sorting destinations to specific outputs 502. The sorting destination may, for example, correspond to a geographic destination of the parcels. As the parcels are sorted, the parcels corresponding to each sorting destination are delivered to the corresponding output 502 and into the corresponding container 508. The sorting destinations can be re-assigned as necessary. For example, the destination output for a first destination may be assigned to a first output 502*a*. When the system determines that a sufficient volume or number of parcels have been sorted to the first output 502*a*, for example by determining that the corresponding container is full and should be replaced, the system can re-assign that sorting destination to a second output 502*b*. At that point, the container at the first output can be replaced with an empty container while the parcels sorted to the first destination are sent to the now-assigned second output 502*b*. When an empty container has been placed at the first output 502*a*, the system can then assign another sorting destination to the first output 502*a*. In this way, the sorting process need not be "paused" while containers are exchanged.

Figure 6:
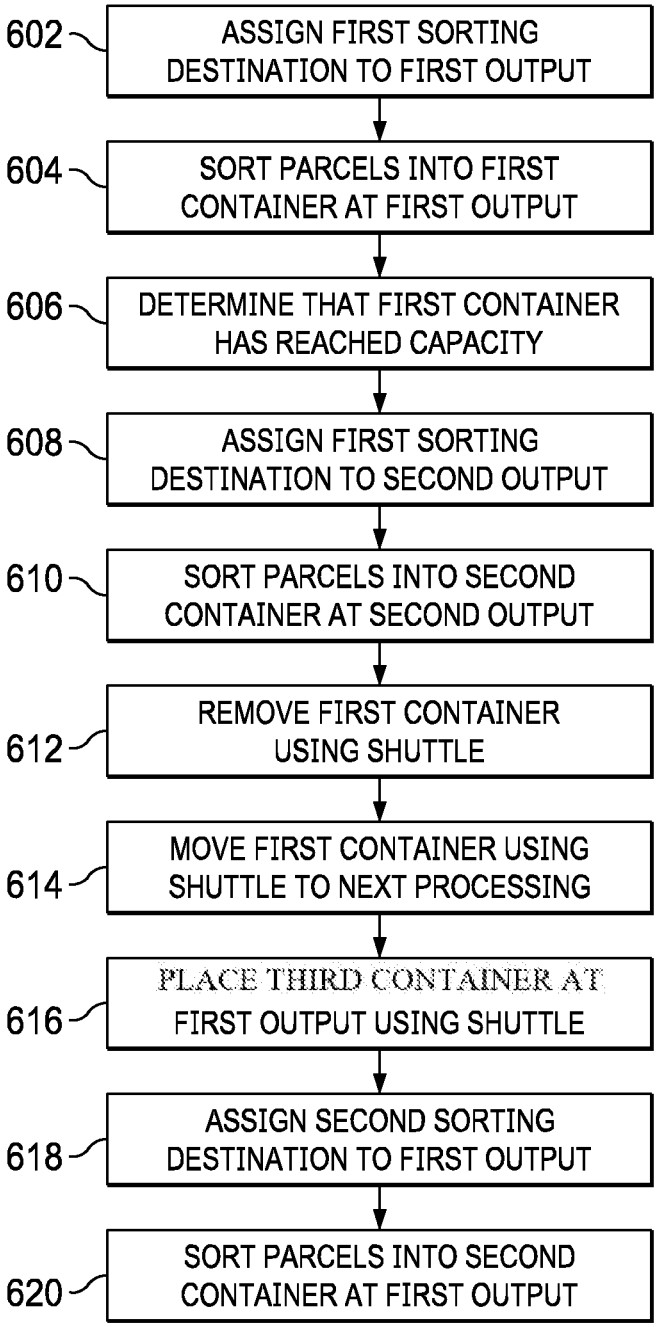
FIG. 6 illustrates a flowchart of a process in accordance with disclosed embodiments.

FIG. 6 illustrates a flowchart of a process 600 that can be performed by a sorting system 500 in accordance with disclosed embodiments, for example under the direction of the control system of the sorting system.

The sorting system assigns a first sorting destination to a first output of the sorting system (602). For purposes of this example, the first output already has an empty first container.

The sorting system sorts parcels corresponding to the first sorting destination to the first output and deposits them in the first container (604).

The sorting system determines that the first container has reached a target capacity (606). The target capacity can be, for example, the capacity of a parcel sack, the capacity of the first container, a target weight capacity, some portion of any of these capacities, or another predefined capacity.

The sorting system assigns the first sorting destination to a second output (608). The second output has a second container.

The sorting system sorts parcels corresponding to the first sorting destination to the second output and deposits them in the second container (610).

The sorting system removes the full first container using a first shuttle (612). In various embodiments, this can be done by moving a first shuttle to the first output and using a transfer mechanism to move the first container onto the first shuttle. In other embodiments, the first container is on the first shuttle as it is being filled, and the sorting system simply carries the first container away. The first shuttle can notify the sorting system that the first container has been removed.

The sorting system moves the first container, using the first shuttle, to the next processing stage (614).

The sorting system places an empty third container (or a third container that has not reached the target capacity) into place to receive parcels at the first output using a second shuttle (616). In some cases, the second shuttle can be the first shuttle after the first container was removed from the first shuttle and the third container was placed in the first shuttle. The second shuttle can notify the sorting system that the third container is in place. The sorting system can change a status of the first output to indicate that it is available for assignment.

In still other embodiments, the second shuttle can be the first shuttle where the first shuttle has a cargo area sized to carry multiple containers. In such cases, the same shuttle both takes the full first container from the first output and at the same time is delivering the empty third container to the first output. This way, the dual-capacity shuttle arrives at the first output already carrying an empty third container. It takes the full first container and replaces it at the first output with the empty third container. The shuttle can then carry the full first container to the next processing stage and can leave an open container position in the cargo area. The shuttle can unload the full first container at the next processing stage and load another empty container for its next run.

The sorting system assigns a second sorting destination to the first output of the sorting system (618). When needed, the second sorting destination can be the same as the first sorting destination.

The sorting system sorts parcels corresponding to the second sorting destination to the first output and deposits them in the third container (620).

In various embodiments, the sorting system moves the shuttles in and out of place to remove and replace filled containers at a rate corresponding to the rate at which the containers reach the target capacity.

Figure 7:
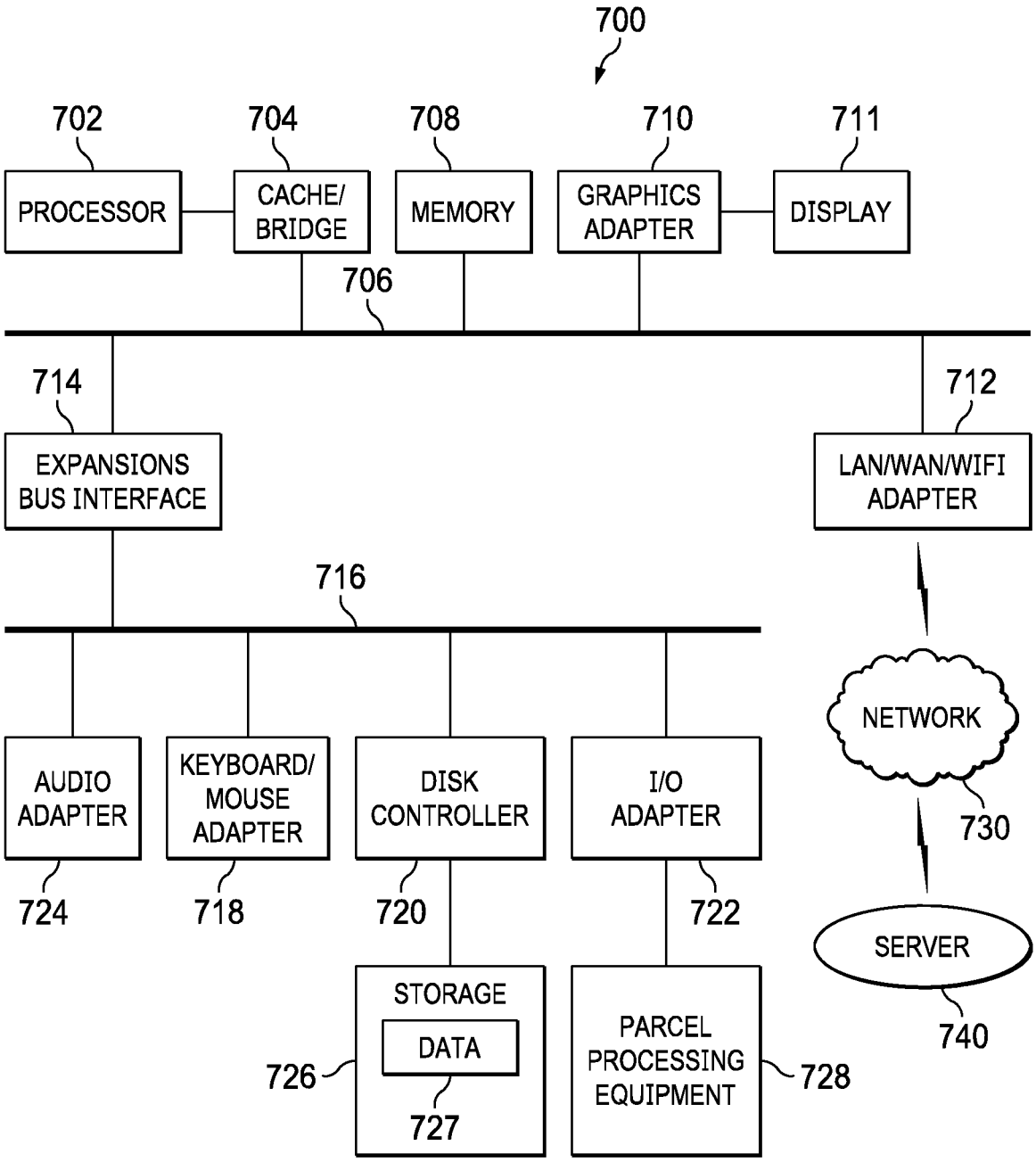
FIG. 7 illustrates a block diagram of a data processing system with which an embodiment can be implemented.

FIG. 7 illustrates a block diagram of a data processing system 700 with which an embodiment can be implemented, for example as control system or other device configured by software or otherwise to perform the processes as described herein, and in particular as each one of a plurality of interconnected and communicating systems as described herein. The exemplary, non-limiting data processing system 700 can be used, for example, as the control system of the sorting system and/or as a control system of each shuttle. The data processing system depicted includes a processor 702 connected to a level two cache/bridge 704, which is connected in turn to a local system bus 706. Local system bus 706 may be, for example, a peripheral component interconnect (PCI) architecture bus. Also connected to local system bus in the depicted example are a main memory 708 and a graphics adapter 710. The graphics adapter 710 may be connected to display 711.

Other peripherals, such as local area network (LAN)/Wide Area Network/Wireless (e.g. WiFi) adapter 712, may also be connected to local system bus 706. Expansion bus interface 714 connects local system bus 706 to input/output (I/O) bus 716. I/O bus 716 is connected to keyboard/mouse adapter 718, disk controller 720, and I/O adapter 722. Disk controller 720 can be connected to a storage 726, which can be any suitable machine usable or machine readable storage medium, including but not limited to nonvolatile, hard-coded type mediums such as read only memories (ROMs) or erasable, electrically programmable read only memories (EEPROMs), magnetic tape storage, and user-recordable type mediums such as floppy disks, hard disk drives and compact disk read only memories (CD-ROMs) or digital versatile disks (DVDs), and other known optical, electrical, or magnetic storage devices. Storage 726 can store any data 727 useful in performing processes as described herein, including any executable instructions, identifiers, statuses, shuttle locations, capacities, or other data.

I/O adapter 722 is connected to control parcel processing equipment 728, which can be any of the elements illustrated in FIGS. 1-5.

Also connected to I/O bus 716 in the example shown is audio adapter 724, to which speakers (not shown) may be connected for playing sounds. Keyboard/mouse adapter 718 provides a connection for a pointing device (not shown), such as a mouse, trackball, trackpointer, touchscreen, etc.

Those of ordinary skill in the art will appreciate that the hardware depicted in FIG. 7 may vary for particular implementations. For example, other peripheral devices, such as an optical disk drive and the like, also may be used in addition or in place of the hardware depicted. The depicted example is provided for the purpose of explanation only and is not meant to imply architectural limitations with respect to the present disclosure.

A data processing system in accordance with an embodiment of the present disclosure includes an operating system employing a graphical user interface. The operating system permits multiple display windows to be presented in the graphical user interface simultaneously, with each display window providing an interface to a different application or to a different instance of the same application. A cursor in the graphical user interface may be manipulated by a user through the pointing device. The position of the cursor may be changed and/or an event, such as clicking a mouse button, generated to actuate a desired response.

One of various commercial operating systems, such as a version of Microsoft WINDOWS™, a product of Microsoft Corporation located in Redmond, Wash. may be employed if suitably modified. The operating system is modified or created in accordance with the present disclosure as described.

LAN/WAN/Wireless adapter 712 can be connected to a network 730 (not a part of data processing system 700), which can be any public or private data processing system network or combination of networks, as known to those of skill in the art, including the Internet. Data processing system 700 can communicate over network 730 with server system 740, which is also not part of data processing system 700, but can be implemented, for example, as a separate data processing system 700. Data processing system 700 can communicate with other elements as disclosed herein, such as communications between the sorting system and the shuttles, communications between shuttles, etc.

Those skilled in the art will recognize that, for simplicity and clarity, the full structure and operation of all systems suitable for use with the present disclosure is not being depicted or described herein. Instead, only so much of the physical systems as is unique to the present disclosure or necessary for an understanding of the present disclosure is depicted and described. The remainder of the construction and operation of the systems disclosed herein may conform to any of the various current implementations and practices known in the art.

It is important to note that while the disclosure includes a description in the context of a fully functional system, those skilled in the art will appreciate that at least portions of the mechanism of the present disclosure are capable of being distributed in the form of a instructions contained within a machine-usable, computer-usable, or computer-readable medium in any of a variety of forms, and that the present disclosure applies equally regardless of the particular type of instruction or signal bearing medium or storage medium utilized to actually carry out the distribution. Examples of machine usable/readable or computer usable/readable mediums include: nonvolatile, hard-coded type mediums such as read only memories (ROMs) or erasable, electrically programmable read only memories (EEPROMs), and user-recordable type mediums such as floppy disks, hard disk drives and compact disk read only memories (CD-ROMs) or digital versatile disks (DVDs). In particular, computer readable mediums can include transitory and non-transitory mediums, unless otherwise limited in the claims appended hereto.

Although an exemplary embodiment of the present disclosure has been described in detail, those skilled in the art will understand that various changes, substitutions, variations, and improvements disclosed herein may be made without departing from the spirit and scope of the disclosure in its broadest form. In particular, the features and operations of various examples described herein and in the incorporated applications can be combined in any number of implementations.

None of the description in the present application should be read as implying that any particular element, step, or function is an essential element which must be included in the claim scope: the scope of patented subject matter is defined only by the allowed claims. Moreover, none of these claims are intended to invoke 35 USC § 112(f) unless the exact words "means for" are followed by a participle.

What is claimed is:

1. A parcel sorting system comprising:

a parcel sorter having a plurality of outputs;

a plurality of shuttles, wherein the shuttles are configured to travel on shuttle tracks to positions proximate to each of the outputs; and a control system, configured to control the parcel sorting system to:

assign a first sorting destination to a first output of the plurality of outputs, wherein a first container is positioned to receive parcels sorted to the first output;

sort parcels corresponding to the first sorting destination to the first output and deposit the parcels into the first container;

when the first container has reached a target capacity, remove the full first container using a first shuttle;

position a third container to receive parcels sorted to the first output using a second shuttle; and when the first container has reached the target capacity, assign the first sorting destination to a second output of the plurality of outputs, wherein a second container is positioned to receive parcels sorted to the second output.

2. The parcel sorting system of claim 1, wherein the control system is further configured to control the parcel sorting system to, after the third container is positioned to receive parcels sorted to the first output, assign a second sorting destination to the first output.

3. The parcel sorting system of claim 1, wherein the target capacity is one of a capacity of a parcel sack, a capacity of the first container, or a target weight capacity.

4. The parcel sorting system of claim 1, further comprising a transfer mechanism configured to move the first container onto the first shuttle from being positioned to receive parcels sorted to the first output.

5. The parcel sorting system of claim 1, wherein the shuttle tracks comprise a rail system along which the plurality of shuttles travel.

6. The parcel sorting system of claim 1, wherein the control system is further configured to control the parcel sorting system to, after the third container is positioned to receive parcels sorted to the first output, change a status of the first output to indicate that the first output is available for assignment.

7. The parcel sorting system of claim 1, wherein the first shuttle is the second shuttle and is configured to transport two containers at the same time.

8. A process performed by a parcel sorting system, comprising:

assigning a first sorting destination to a first output of a plurality of outputs of the parcel sorting system, wherein a first container is positioned to receive parcels sorted to the first output;

sorting parcels corresponding to the first sorting destination to the first output and depositing the parcels into the first container;

when the first container has reached a target capacity, removing the full first container using a first shuttle, wherein the first shuttle is one of a plurality of shuttles configured to travel on shuttle tracks to positions proximate to each of the outputs; and positioning a third container to receive parcels sorted to the first output using a second shuttle of the plurality of shuttles; and when the first container has reached the target capacity, assigning the first sorting destination to a second output of the plurality of outputs, wherein a second container is positioned to receive parcels sorted to the second output.

9. The process of claim 8, further comprising, after the third container is positioned to receive parcels sorted to the first output, assigning a second sorting destination to the first output.

10. The process of claim 8, wherein the target capacity is one of a capacity of a parcel sack, a capacity of the first container, or a target weight capacity.

11. The process of claim 8, further comprising moving the first container onto the first shuttle from being positioned to receive parcels sorted to the first output, using a transfer mechanism.

12. The process of claim 8, wherein the shuttle tracks comprise a rail system along which the plurality of shuttles travel.

13. The process of claim 8, further comprising, after the third container is positioned to receive parcels sorted to the first output, changing a status of the first output to indicate that the first output is available for assignment.

14. The process of claim 8, wherein the first shuttle is the second shuttle and is configured to transport two containers at the same time.

15. A non-transitory machine readable medium storing executable instructions that, when executed, cause a control system of a parcel sorting system to:

assign a first sorting destination to a first output of a plurality of outputs of the parcel sorting system, wherein a first container is positioned to receive parcels sorted to the first output;

sort parcels corresponding to the first sorting destination to the first output and deposit the parcels into the first container;

when the first container has reached a target capacity, remove the full first container using a first shuttle, wherein the first shuttle is one of a plurality of shuttles configured to travel on shuttle tracks to positions proximate to each of the outputs;

position a third container to receive parcels sorted to the first output using a second shuttle of the plurality of shuttles;

when the first container has reached the target capacity, assign the first sorting destination to a second output of the plurality of outputs, wherein a second container is positioned to receive parcels sorted to the second output.

16. The non-transitory machine readable medium of claim 15, wherein the control system is further caused to, after the third container is positioned to receive parcels sorted to the first output, assign a second sorting destination to the first output.

17. The non-transitory machine readable medium of claim 15, wherein the first shuttle is the second shuttle and is configured to transport two containers at the same time.

* * * * *